US008783339B2

(12) United States Patent
Sinclair et al.

(10) Patent No.: US 8,783,339 B2
(45) Date of Patent: Jul. 22, 2014

(54) TUBULAR MEMBER ADAPTOR APPARATUS

(75) Inventors: Edward Sinclair, Aberdeenshire (GB); Guy Hustinx, Aberdeen (GB); Patrick Neil Sibille, Aberdeen (GB)

(73) Assignee: Frank's International, Inc., Houston, TX (US)

( * ) Notice: Subject to any disclaimer, the term of this patent is extended or adjusted under 35 U.S.C. 154(b) by 434 days.

(21) Appl. No.: 13/007,263

(22) Filed: Jan. 14, 2011

(65) Prior Publication Data

US 2011/0174542 A1 Jul. 21, 2011

Related U.S. Application Data

(60) Provisional application No. 61/295,529, filed on Jan. 15, 2010, provisional application No. 61/296,781, filed on Jan. 20, 2010.

(51) Int. Cl.

| | |
|---|---|
| ***E21B 19/16*** | (2006.01) |
| ***E21B 19/06*** | (2006.01) |
| ***E21B 7/20*** | (2006.01) |

(52) U.S. Cl.

USPC ..... 166/77.52; 166/85.1; 175/171; 294/85.24

(58) Field of Classification Search

USPC ..... 166/379, 380, 382, 71, 77.1, 77.52, 166/77.53, 85.1; 175/57, 113, 170, 171, 175/423; 294/86.24, 86.25, 86, 26, 86.12

See application file for complete search history.

(56) References Cited

U.S. PATENT DOCUMENTS

| | | | | |
|---|---|---|---|---|
| 4,449,596 | A | 5/1984 | Boyadjieff | |
| 6,309,002 | B1 | 10/2001 | Bouligny | |
| 6,431,626 | B1 | 8/2002 | Bouligny | |
| 7,757,759 | B2 * | 7/2010 | Jahn et al. | 166/250.01 |
| 2001/0042625 | A1 | 11/2001 | Appleton | |
| 2006/0118293 | A1 | 6/2006 | Juhasz et al. | |
| 2007/0251701 | A1 | 11/2007 | Jahn et al. | |
| 2008/0210063 | A1 | 9/2008 | Slack | |
| 2009/0145594 | A1 | 6/2009 | Slack | |
| 2009/0314496 | A1 | 12/2009 | Begnaud et al. | |
| 2009/0321086 | A1 | 12/2009 | Zimmermann | |
| 2010/0101805 | A1 | 4/2010 | Angelle et al. | |

OTHER PUBLICATIONS

International Search Report and Written Opinion received in Application No. PCT/US2011/021304, dated Jul. 17, 2012 (7 pages).
International Search Report and Written Opinion in Application No. PCT/US2011/021304, dated Jan. 14, 2011 (12 pages).
Office Action in corresponding Canadian Application No. 2787275 dated Jul. 5, 2013 (3 pages).

* cited by examiner

*Primary Examiner* — Shane Bomar
*Assistant Examiner* — Wei Wang
(74) *Attorney, Agent, or Firm* — Osha Liang LLP

(57) ABSTRACT

Apparatuses, systems, and methods in accordance with the present disclosure are disclosed herein. The system includes a gripping tool operatively connected to and suspended from the top drive assembly, in which the gripping tool includes an axis defined therethrough and a gripping member, and an adaptor apparatus having a first end and a second end. The at least one gripping member engages the adaptor apparatus, and the second end includes a connection member to connect with the tubular member.

20 Claims, 9 Drawing Sheets

TUBULAR MEMBER ADAPTOR APPARATUS

CROSS-REFERENCE TO RELATED APPLICATIONS

This application claims benefit, under 35 U.S.C. §119, of U.S. Provisional Application No. 61/295,529 filed on Jan. 15, 2010, and of U.S. Provisional Application No. 61/296,781 filed on Jan. 20, 2010, both entitled "Tubular Member Adaptor Apparatus." The disclosure of this U.S. Provisional Application is incorporated herein by reference in its entirety.

BACKGROUND OF INVENTION

1. Field of Disclosure

Embodiments disclosed herein generally relate to methods and apparatus to support and/or move tubular members. More specifically, embodiments disclosed herein relate to apparatus that are used to dispose one or more tubular members into subterranean wellbores, such as within the oil and gas industry.

2. Background Art

In oilfield exploration and production operations, various oilfield tubular members are used to perform various tasks, including, but not limited to, drilling and casing drilled wellbores. For example, an assembly of threaded pipes, known in the industry as a drill string, may be used to rotate a drill bit at a distal end thereof to create the wellbore. Furthermore, after a wellbore has been created, a casing string may be disposed downhole into the wellbore and cemented in place to stabilize, reinforce, and/or (among other functions) isolate portions of the wellbore.

As such, strings of drill pipe and casing may be connected together, such as end-to-end by threaded connections, in which a male "pin" threaded member of a first tubular member is configured to threadably connect to a corresponding female "box" threaded member of a second tubular member. Alternatively, a tubular string may be made-up of a series of male-male ended casing joints coupled together by female-female couplers. The process by which the threaded connections are screwed together is called "making-up" a threaded connection, and the process by which the connections are disassembled is referred to as "breaking-out" the threaded connection. As would be understood by one having ordinary skill, individual pieces (or "joints") of oilfield tubular members may come in a variety of weights, diameters, configurations, and lengths.

Referring to FIG. 1, a schematic view of a drilling rig 101 used to run a drill string 115 of one or more tubular members 111 (e.g., casing, drill pipe, etc.) downhole into a wellbore is shown. As shown, drilling rig 101 includes a frame structure known as a "derrick" 102, from which a traveling block 103, a first gripping apparatus 105 (e.g., a casing running tool or conventional string elevator), a top drive assembly 145, and a second gripping apparatus 107 (e.g., slip assembly or spider) may be used to manipulate (e.g., raise, lower, rotate, hold, etc.) a tubular member 111. Traveling block 103 may be suspended from or near the top of derrick 102, in which traveling block 103 may move up-and-down (i.e., vertically as depicted) to raise and/or lower tubular member 111. Traveling block 103 may be a simple "pulley-style" block and may have a hook 104 from which objects below (e.g., first gripping apparatus 105 and/or top drive assembly 145) may be suspended.

Additionally, first gripping apparatus 105 may be coupled below traveling block 103 (and a top drive assembly 145 if present) to selectively grab or release a tubular member 111 to be raised and/or lowered within and from derrick 102. Further, top drive assembly 145 may include one or more guiding rails and/or a track 108 disposed adjacent to top drive assembly 145. Guiding rails or track 108 may be used by top drive assembly 145 to support and guide top drive assembly 145 as top drive assembly 145 is raised and/or lowered within derrick 102.

A typical top drive assembly may include pipe handling equipment used to make-up and break-out connections of drill string when sections are to be added or removed from the string. Further, a top drive assembly may include a torque wrench that may be connected permanently to a source of hydraulic or other power that may be operated, such as remotely. As such, a top drive assembly may be used to make-up and break-out pipe connections as well as to provide the power necessary to drill the well. An example of a top drive assembly is disclosed within U.S. Pat. No. 4,449,596, filed on Aug. 3, 1982, and entitled "Drilling of Wells with Top Drive Unit," which is incorporated herein by reference in its entirety.

Such pipe handling equipment that may be attached to top drive assembly 145 (e.g., the rotatable quill thereof) may be first gripping apparatus 105. Typically, first gripping apparatus 105 may include movable gripping members (i.e., slips) attached thereto and movable between various open and closed positions. In a closed position, first gripping apparatus 105 may support tubular member 111 so that tubular member 111 may be raised and/or lowered, and rotated if so equipped with a tubular running tool connected to a quill of top drive assembly 145. In an open position, first gripping apparatus 105 may release tubular member 111 and move away therefrom to allow tubular member 111 to be engaged with or removed from first gripping apparatus 105. For example, first gripping apparatus 105 may release (inner and/or outer surface of) tubular member 111 after tubular member 111 is threadably connected to drill string 115 supported by drilling rig 101.

Referring now to FIG. 2A, a perspective view of a gripping tool 205 disposed within a drilling rig 201 is shown. Drilling rig 201 includes a top drive assembly 245 suspended by a traveling block 203 and a hook 204, in which top drive assembly 245 is disposed along guiding rails 208. A gripping tool 205 may be suspended from top drive assembly 245, in which gripping tool 205 may be engaged with a tubular member 211 (e.g. casing) such as with at least one gripping member 249 may be disposed within the tubular member that may be used to grip an internal surface of tubular member 211. As such, FIG. 2A shows the gripping tool 205 as an internal gripping tool that grips an internal surface of tubular members. Further, the gripping tool 205 may have a seal member 206 attached thereto, such as a packer cup (as shown), in which the seal member 206 may removably attach to the gripping tool 205. As such, the seal member 206 may be able to threadably connect to the gripping tool 205, in which the seal member 206 may be able to sealingly engage with an inner surface of the tubular member 211.

An alternative embodiment for a gripping tool may be an external gripping tool, such as with an external gripping tool 305 shown in FIGS. 3A and 3B. As such, gripping tool 305 may allow gripping members 349 of gripping tool 305 to grip an external surface of tubular member 311. An example of an external gripping tool is disclosed within U.S. patent application Ser. No. 12/604,327, filed on Oct. 22, 2009, and entitled "External Grip Tubular Running Tool," which is incorporated herein by reference in its entirety. As such, torque from top drive assembly 345 may be transferred further from gripping tool 305 to tubular member 311 and may be used to run tubular member 311 into a wellbore 350. Further, the gripping tool 305 may have a seal member 306 attached thereto, such as a packer cup, in which the seal member 306 may be able to sealingly engage with an inner surface of the tubular member 311.

Additionally, in FIGS. 2A and 2B, top drive assembly 245 may be raised and lowered along guide rails 208 by traveling block 203. This allows the weight disposed on tubular member 211 to be manipulated, e.g., to adjust for different drilling conditions downhole. For example, if running tubular member 211 in wellbore 250 becomes difficult and additional weight on tubular member 211 is needed to proceed with advancement of tubular member 211 downhole, top drive assembly 245 may be lowered by traveling block 203 along guide rails 208 to provide additional downward force to help further guide tubular member 211 into wellbore 250. Conversely, traveling block 203 may be used to raise top drive assembly 245 along guide rails 208 so as to reduce the weight on tubular member 211.

The process of drilling subterranean wells typically includes drilling a hole in the earth down to a reservoir or formation in which a substance is intended to be removed from or injected. Typically, when drilling a wellbore, the wellbore may be drilled in multiple sections, rather than a single section. After each section of the well is drilled, a casing string (e.g., a string of tubular members) may be landed within the drilled wellbore. Casing is usually assembled from multiple tubular members connected together and placed in the wellbore to form a conduit extending from the subterranean reservoir to the surface. Casing may prevent the wellbore from collapsing and may also provide a barrier to the flow of fluids between the formations that the wellbore penetrates. A string of casing is typically cemented in place once the string is run into the wellbore. The string of casing may have more than one section having a different diameter from other adjacent sections of casing.

Further, with reference to FIGS. 2A and 2B, gripping tool 205 (e.g., casing running tool) may be operatively connected to a top drive assembly 245 and may incorporate a method of picking up single joints of casing and stabbing them into the string. Prior to casing operations, gripping tool 205 may be operatively connected below top drive assembly 245 and may incorporate a set of slips 207 to grip the casing. These slips 207 may support the entire casing string and may transmit the torque required to make-up and rotate the casing connections. An elevator (not shown), e.g., a single joint elevator, supported by gripping tool 205 or otherwise disposed on the rig, may be used to lift the joints of casing to the well center so that each joint may be stabbed into the previous joint. Top drive mounted gripping tool 205 may be lowered into well 250 until gripping tool 205 may engage the new joint being added. The gripping members 249 of gripping tool 205 are set on the joint of casing and the top drive assembly may now be energized, applying the required torque through gripping tool 205 to casing connection 211. Further, gripping tool 205 may include a circulating tool (not shown) so that, at any point in the casing running process, the tool may seal to casing to supply fluid to the casing, e.g., allowing fluid circulation to the bore of the casing run into the wellbore.

As such, after drilling of each section of the wellbore is complete, a drill string, such as drill string 215 shown in FIG. 2B, may be removed from wellbore 250 periodically such that casing may be placed therein. This process commonly involves removing drill string 215 from wellbore 250 (e.g., tripping out of the hole), as shown in FIG. 2B, and using top drive supported gripping tool 205 (e.g., casing running tool) to run casing 211 down hole, as shown in FIG. 2A. Casing is commonly run into the bore one joint or stand at a time, in which each next joint may be picked up and connected to the top most joint of the casing string extending from the wellbore 250. Once the joint (or stand) of casing has been connected to the casing string, gripping tool 205 may be moved into engagement with the added joint and used to secure the casing string. The casing string may be lifted by the first gripping apparatus (e.g., shown as an internal gripping casing running tool), thus allowing a second gripping apparatus 207 (e.g., the spider) to release the casing string. Once second gripping apparatus 207 has released the casing string, the casing string may be lowered into wellbore 250, e.g., via the first gripping apparatus.

Once the desired length of casing string is made-up, the casing string may then be run downhole to a desired location. For example, in an offshore environment, the casing string may be run to a downhole hanger disposed adjacent to the seafloor using a landing string. Once the casing string is positioned into the desired location (e.g., hung from the downhole hanger), the landing string may be unlatched from the casing string disposed downhole, and the landing string may be removed (e.g., tripped out) from the borehole.

In such applications, the first gripping apparatus for a casing string, e.g., top drive connected casing running tool 205, may not be desirable to connect directly to or capable of engaging (e.g., gripping) to the landing string. Rather, as the casing running tool 205 is used to run casing 211 downhole, a landing string, which may have a smaller diameter than the casing, may not successfully connect to or engage with the casing running tool. In some embodiments, the second gripping apparatus (e.g., spider) at the floor of the rig may be capable of engaging (e.g., gripping and supporting) the casing string and/or the landing string. For example, when switching from running the casing string to running a landing string, first gripping apparatus, e.g., top drive connected casing running tool 205 drive mounted, used to run the casing string down hole may be disconnected from the drilling rig (e.g., the traveling block 203 and/or quill of the top drive), as shown in FIG. 2B, and the landing string may be engaged (e.g., supported) by the drilling rig by a landing string (e.g., drill string) elevator or by the rotatable quill of the top drive assembly 245. However, the time to rig up and down (i.e., mounting and dismounting) the first gripping apparatus (e.g., casing running tool) may be significant, particularly in light of the costs of drilling operations offshore. For example, when switching between running a casing string and running a landing string, one may have significant time savings by avoiding rigging up and/or down the first gripping apparatus (e.g., casing running tool or string elevator).

The time used during the mounting/dismounting of the gripping tool may slow production, and therefore may increase drilling costs. Further, this may cause casing to remain static in an open hole for extended periods of time and the circulation of fluids may also be stopped. This may cause down time which may be problematic when the fluid may need to be circulated in order to maintain the pressure of the well which may further extend production time and costs. Accordingly, there exists a need to utilize the tool used to run casing into a wellbore to accommodate for also running a landing string.

SUMMARY OF INVENTION

In one aspect, embodiments disclosed herein relate to a system to connect a top drive drilling assembly to a tubular member. The system includes a gripping tool operatively connected to and suspended from the top drive assembly, in which the gripping tool includes an axis defined therethrough and a gripping member, and an adaptor apparatus having a first end and a second end. The at least one gripping member engages the adaptor apparatus, and the second end includes a connection member to connect with the tubular member.

In another aspect, embodiments disclosed herein relate to an apparatus to allow a gripping tool of a top drive assembly to connect to a tubular member. The apparatus includes a body having a first end and a second end, in which the first end is configured to be engaged by the gripping tool and the second end includes a connection member to threadably connect to the tubular member.

In another aspect, embodiments disclosed herein relate to a method to run a tubular member with a top drive assembly. The method includes providing a gripping tool between the top drive assembly and the tubular member, the gripping tool having a gripping member and an axis defined therethrough, gripping an adaptor apparatus with the gripping member of the gripping tool, and connecting the adaptor apparatus to a tubular member.

Other aspects and embodiments of the present disclosure will also be discussed with respect to the drawings and descriptions shown further below.

DETAILED DESCRIPTION

Figure 1:
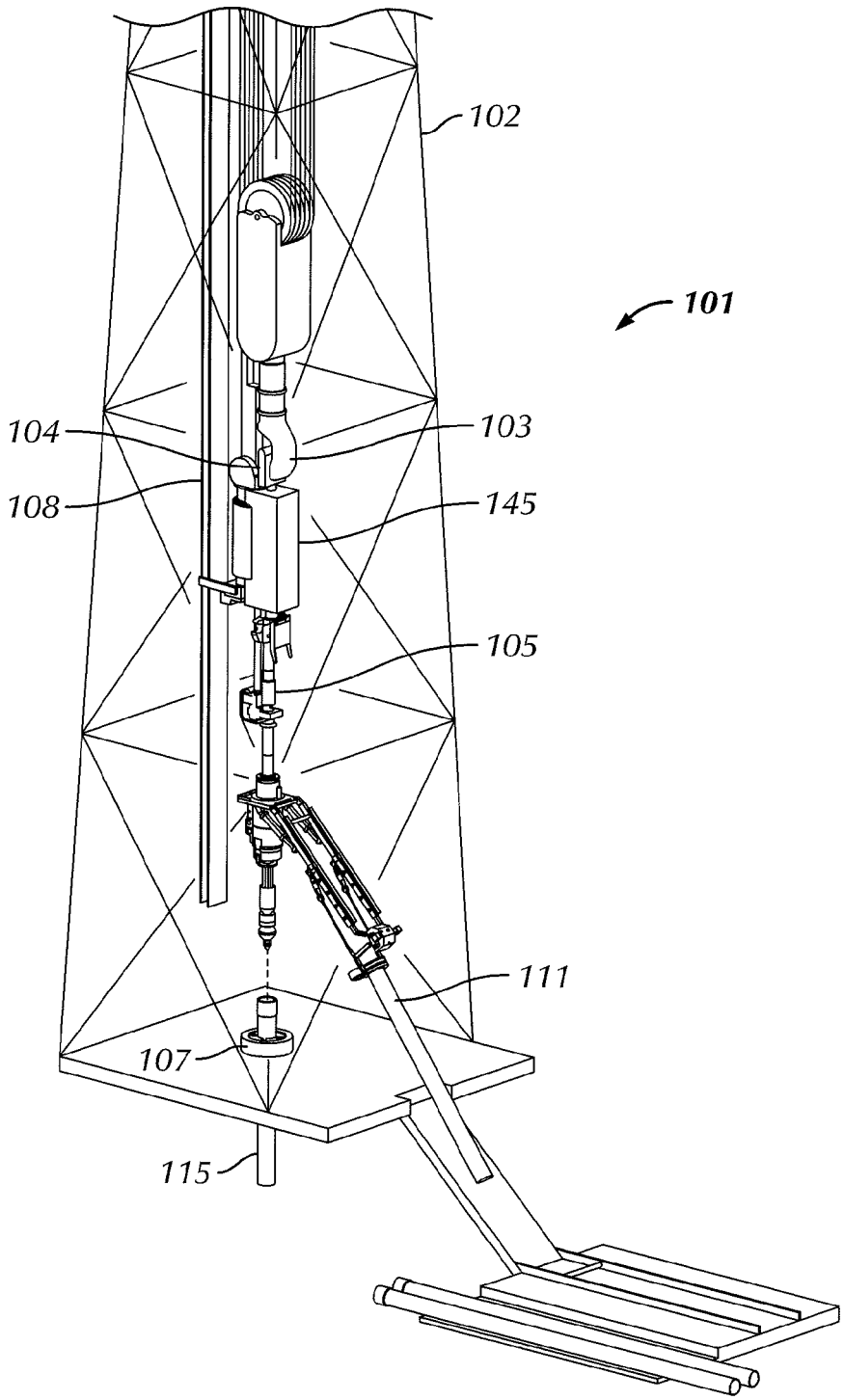
FIG. 1 is a schematic view of a drilling rig.
Figure 2A:
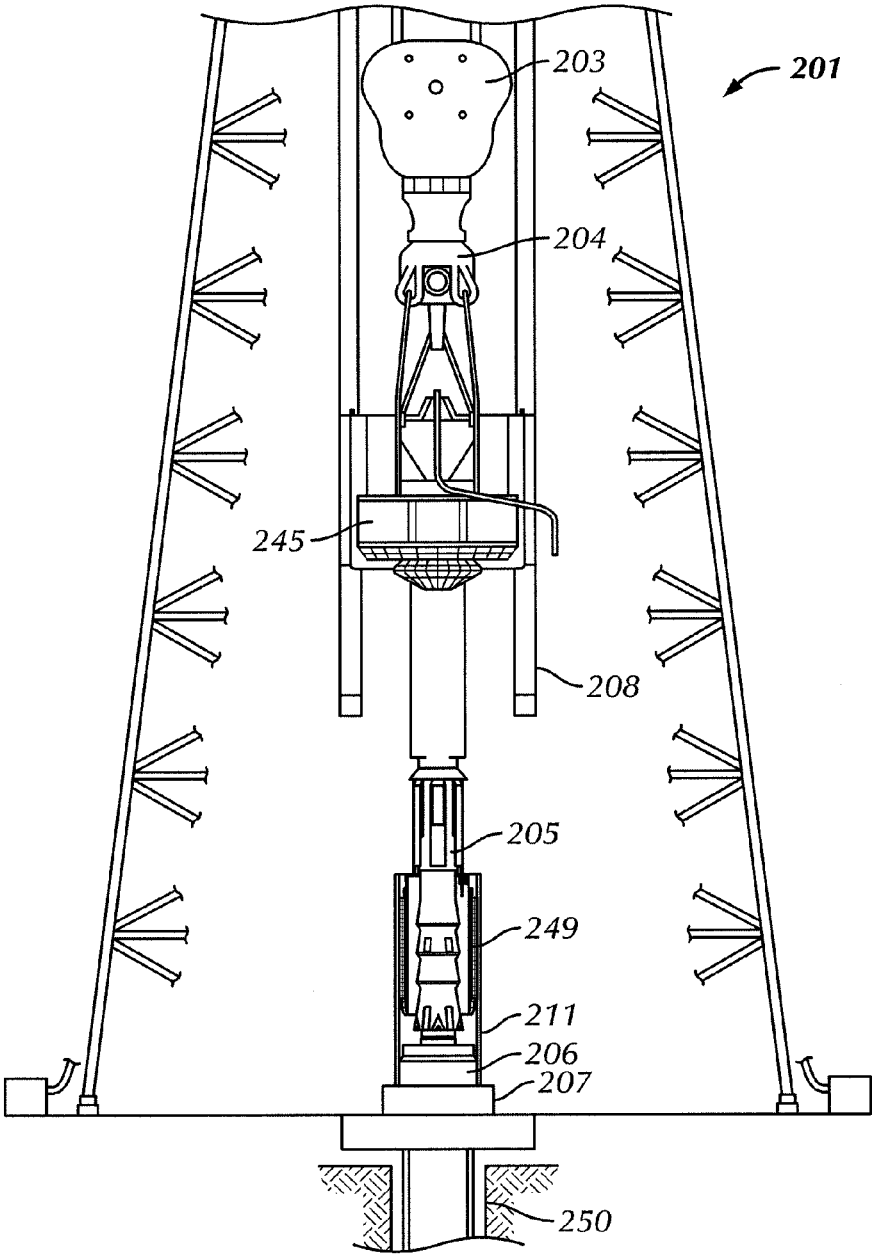
FIGS. 2A and 2B show perspective views of a top drive assembly used within a drilling rig.
Figure 2B:
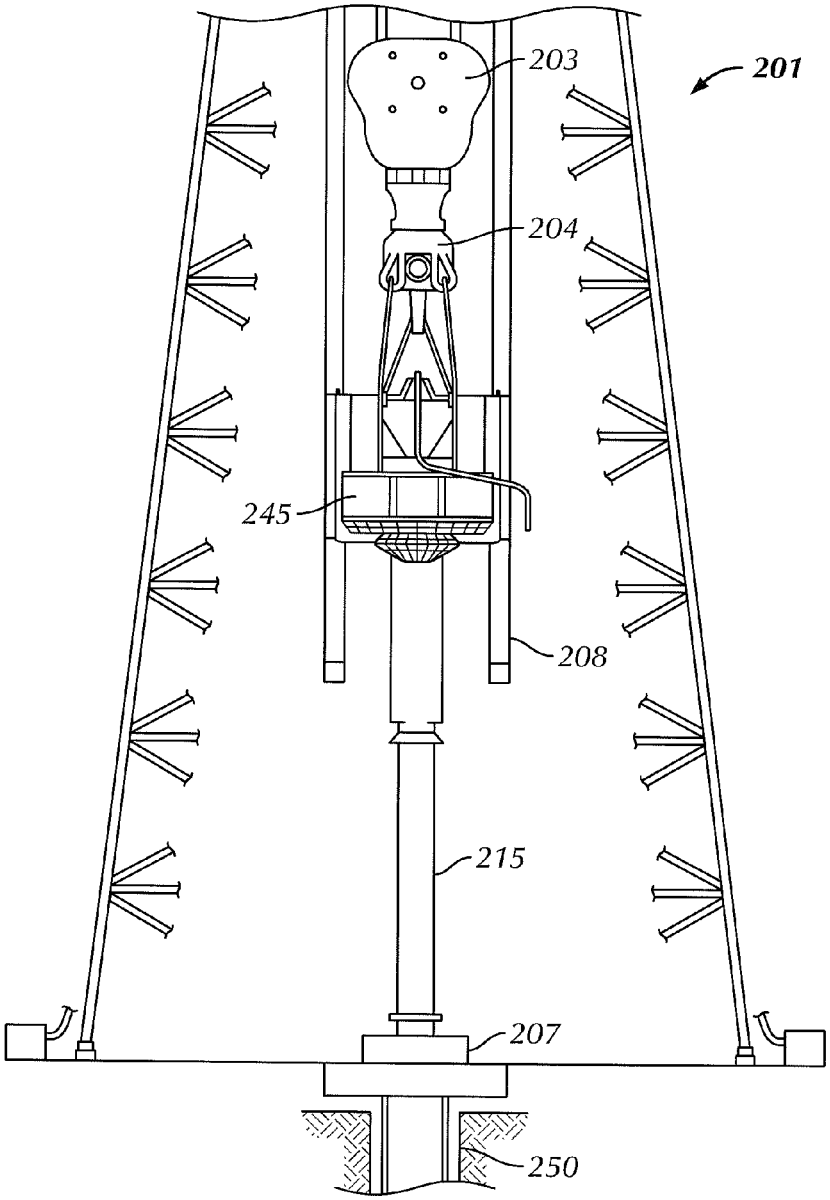
Figure 3A:
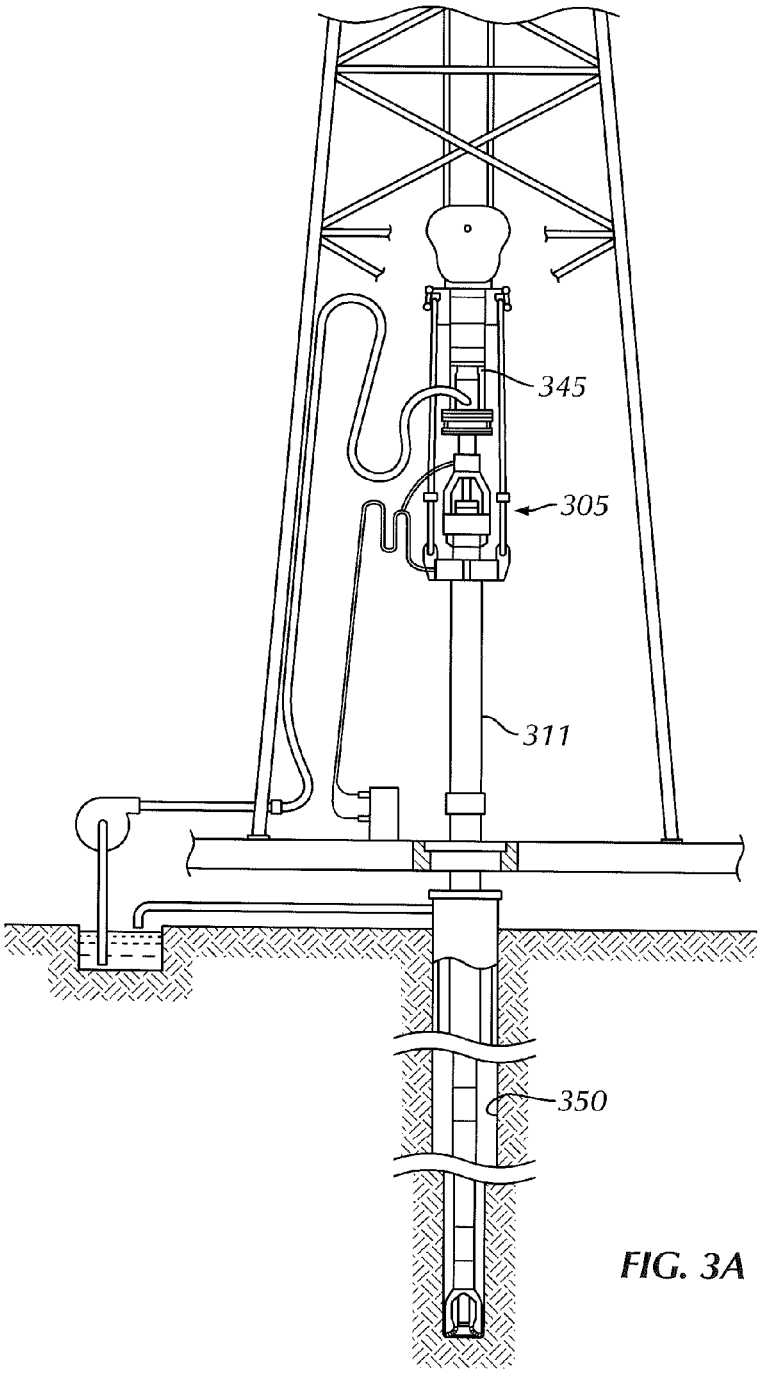
FIGS. 3A and 3B show perspective views of a top drive assembly and a gripping tool used within a drilling rig.
Figure 3B:
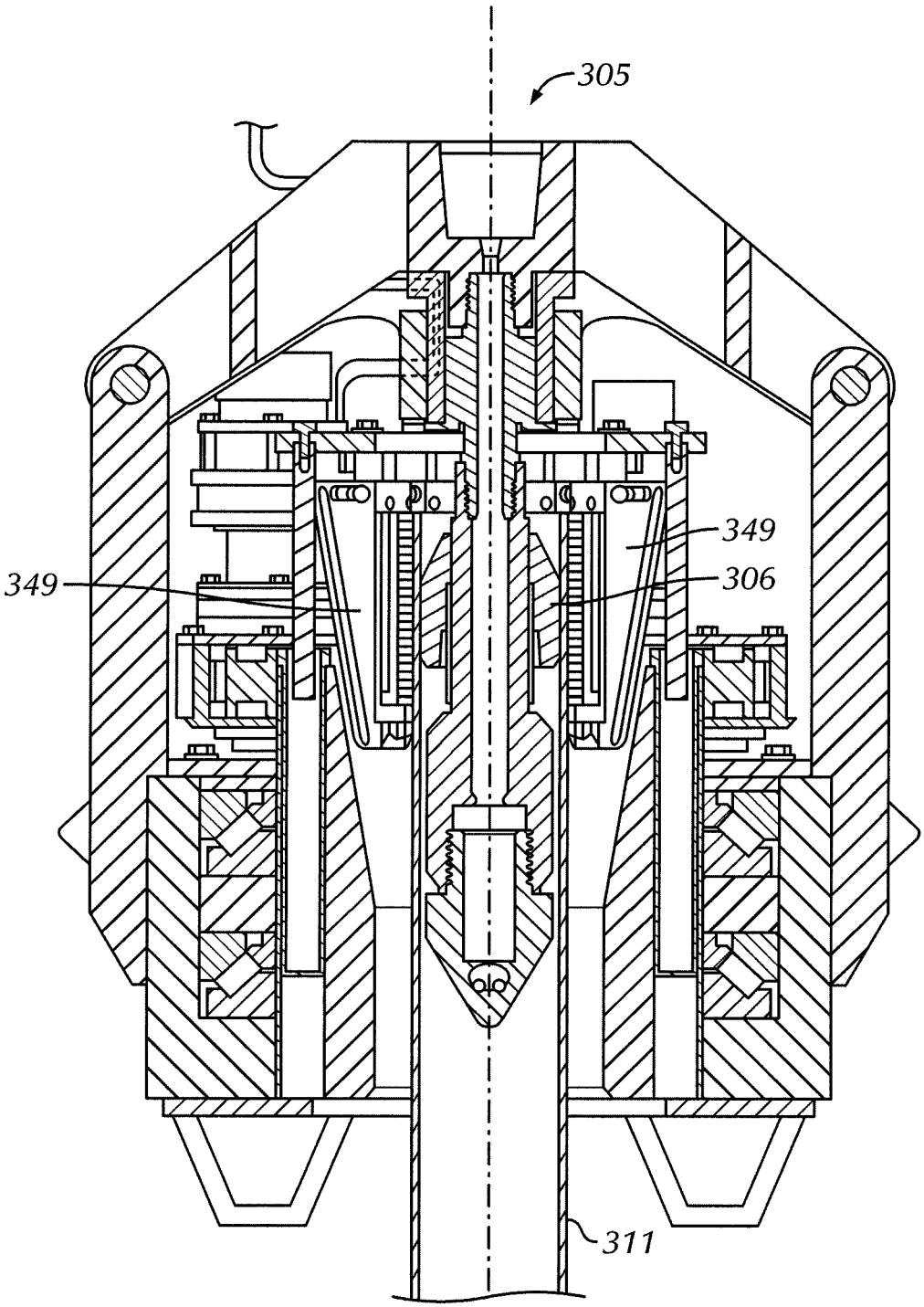

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

In accordance with various aspects of the present disclosure, embodiments disclosed herein generally relate to top drive mounted gripping tools (e.g., casing running tools connected to the quill of the top drive) using an adaptor apparatus to dispose a tubular (e.g. drill pipe) within and/or remove a tubular member from subterranean wellbores. For example, certain embodiments disclosed herein relate to methods and apparatus to transfer torque from a top drive mounted gripping tool to a tubular member using an adaptor apparatus. Particularly, an adaptor apparatus may be engaged with (e.g., gripped by) the top drive mounted gripping tool at one end, and may be threadably connected with a tubular member at the other end. As such, this arrangement may enable torque from the top drive assembly to be transferred through the gripping tool to the adaptor apparatus and, thus, to the tubular member.

Further, the adaptor apparatus may enable torque from the top drive assembly to be transferred to one or more tubular members connected with the adaptor apparatus. As such, in accordance with one or more embodiments of the present disclosure, the adaptor apparatus may allow a top drive assembly to transfer torque to multiple types of tubular members (e.g., drill pipe, casing, and/or landing string) without having to replace and/or reconfigure the top drive assembly and tubular running equipment. For example, the top drive assembly may be able to transfer torque to one or more tubular members connected with the top drive assembly and tubular running equipment, such as by connecting to drill pipe, casing, and/or landing string, and/or the top drive assembly may be able to transfer torque to one or more tubular members connected with other tubular members, such as a casing string attached to a landing string. In such embodiments, the adaptor apparatus may be able to reduce production time in forming wellbores.

In accordance with one or more embodiments of the present disclosure, the adaptor apparatus may be generally cylindrical in shape, such as by having a cylindrical inner surface and/or a cylindrical outer surface, and may include a first end and a second end, in which the first end is adapted to engage with a tubular member gripping tool and the second end is adapted to connect with a tubular member. Those having ordinary skill in the art will appreciate the other structures and arrangements may be used for connecting the adaptor apparatus with a tubular member without departing from the scope of the present disclosure. For example, the adaptor apparatus may be configured to be one of a variety of shapes for both the inner surface and the outer surface, including a hexagonal, rectangular, conical, pyramidal shape, and/or any other shape known to those having skill in the art.

Figure 4A:
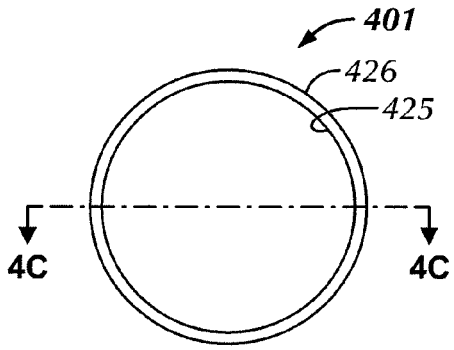
FIGS. 4A-4C show multiple views of an adaptor apparatus in accordance with embodiments disclosed herein.
Figure 4B:
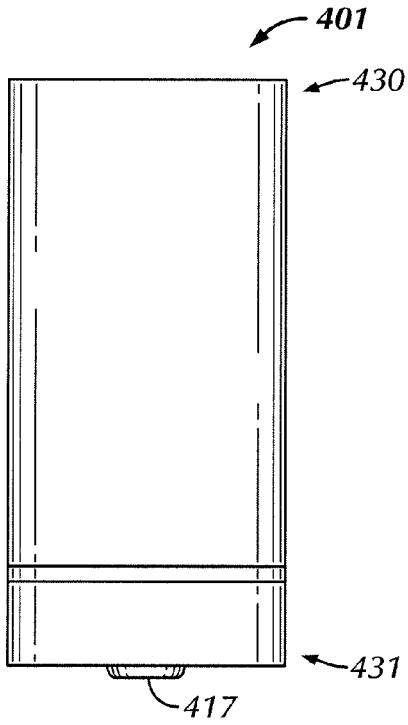
Figure 4C:
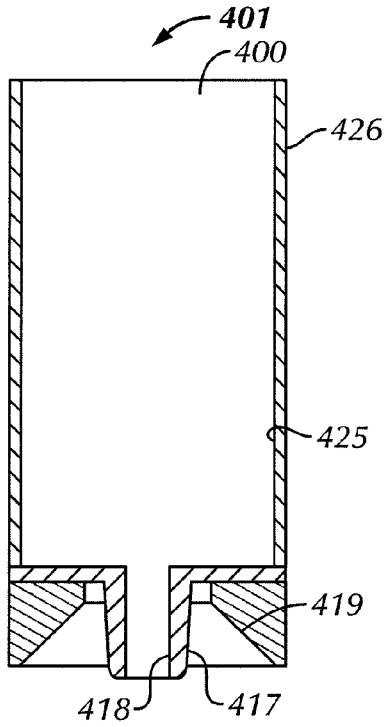

Referring now to FIGS. 4A-4C, multiple views of an adaptor apparatus 401 in accordance with embodiments disclosed herein are shown. Specifically, FIG. 4A shows a top view of the adaptor apparatus, and FIG. 4B shows a side view of the same apparatus. Further, FIG. 4C shows a cross-section side view of the adaptor apparatus along the line A-A of FIG. 4A.

As shown, adaptor apparatus 401 includes a first end 430 and a second end 431, in which first end 430 may be used to engage (e.g., gripped) with a gripping tool (e.g., casing running tool) and second end 431 may be used to threadably connect to a tubular member. In this embodiment, first end 430 of adaptor apparatus 401 may include a bore 400 formed, at least partially, therethrough. Bore 400 may form an inner wall surface 425 and an outer wall surface 426 within adaptor apparatus 401. The relative diameters of inner wall 425 and/or outer wall 426 surfaces may be adapted to substantially match that of a tubular member, such as a section of casing, to facilitate engagement with a gripping tool that is designed to engage with casing. For example, diameter of inner wall 425 may be selected to be engaged (e.g., gripped) by gripping tool (e.g., casing running tool) having a specific diameter or range of diameters that it may grip.

Second end 431 of adaptor apparatus 401 may include a threaded male connection member 417 disposed adjacent to a bell guide 419. Male connection member 417 may be used to threadably connect second end 431 of adaptor apparatus 401 with any member having a corresponding connection member, such as a corresponding female box connection member (not shown). Bell guide 419 may assist in guiding a member having a corresponding connection member to male connection member 417 on second end 431 of adaptor apparatus 401. Bell guide 419 on second end 431 of adaptor apparatus 401 may include an inclined surface formed with respect to an axis defined therethrough, e.g., a generally convergent surface (e.g., convergent towards male connection member 417). Bell guide 419 may also help direct a corresponding connection member to engage with male connection member 417. A corresponding connection member may be directed to male connection member 417 by coming into contact with bell guide 419 and sliding along an inclined surface of bell guide 419 toward male connection member 417. Bell guide 419 may serve as a guide to help direct a corresponding connection member to engage with male pin connection member 417, but may not be necessary in order for male pin connection member 417 of adaptor apparatus 401 to successfully engage with a corresponding connection member. Furthermore, second end 431 of adaptor apparatus 401 may include a hole 418 or port formed therein, such as by having hole 418 formed within male connection member 417. In such embodiments, hole 418 may enable one or more tools and/or components to be fluidly coupled to each other through adaptor apparatus 401.

A tubular member gripping tool may be adapted to engage with a tubular member having one size and/or shape, and the second end of the adaptor apparatus may be adapted to connect with a tubular member having another size and/or shape. As such, the adaptor apparatus may enable the tubular member gripping tool to connect with tubular members having multiple sizes and/or shapes, as mentioned above, through the use of the adaptor apparatus.

For example, a top drive mounted gripping tool may engage with the first end of the adaptor apparatus, and the second end of the adaptor apparatus may connect with a landing string (e.g., drilling string). However, those having ordinary skill in the art will appreciate the other structures and arrangements that may be used for connecting the adaptor apparatus with a tubular member without departing from the scope of the present disclosure. For example, adaptor apparatus 401 may, instead of male pin connection member 417, include a female box connection member (not shown) disposed adjacent to bell guide 419 on second end 431 of adaptor apparatus 401. This female box connection member may be used to engage with the corresponding connecting configuration featured on a tubular member.

Figure 5:
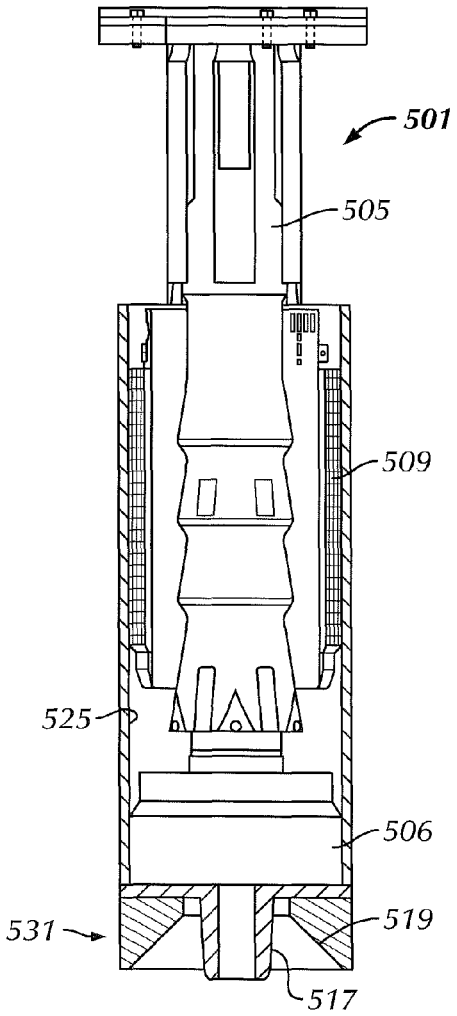
FIG. 5 is a cross-sectional view of an adaptor apparatus engaged with a gripping tool in accordance with embodiments disclosed herein.

Referring now to FIG. 5, a side view of an adaptor apparatus 501 engaged with a gripping tool 505 (e.g., tubular running tool) in accordance with embodiments disclosed herein is shown. As shown, adaptor apparatus 501 may include at least one gripping member (e.g., slip) 509 of gripping tool 505 disposed adjacent a surface of adaptor apparatus 501. Adaptor apparatus 501 may engage with gripping tool 505, such as by moving the at least one gripping member 509 of gripping tool 505 radially outward (as shown) to make contact with an inner wall surface 525.

Further, with reference to FIG. 5, second end 531 of adaptor apparatus 501 may include a bell guide 519 and a connection member to engage a tubular member. For example, in certain embodiments, second end 531 of adaptor apparatus 501 may include male pin connection member 517 disposed adjacent to bell guide 519. However, those having ordinary skill will appreciate that alternative structures and arrangements may be used to connect the adaptor apparatus with a tubular member without departing from the scope of the present disclosure. For example, instead of a male pin connection member, the adaptor apparatus may include a female box connection member, such as disposed adjacent to the bell guide on the second end of the adaptor apparatus. The female box connection member may be used to engage the corresponding connecting configuration featured on a tubular member, such as a male pin connection member or male thread on a tubular member.

Furthermore, the gripping tool 505 may have a seal member 506 attached thereto, such as a packer cup (shown schematically), in which the seal member 506 may removably attach to the gripping tool 505. As such, the seal member 506 may be able to threadably connect to the gripping tool 505, in which the seal member 506 may be able to sealingly engage with the inner surface 525 of the adaptor apparatus 501.

Figure 6:
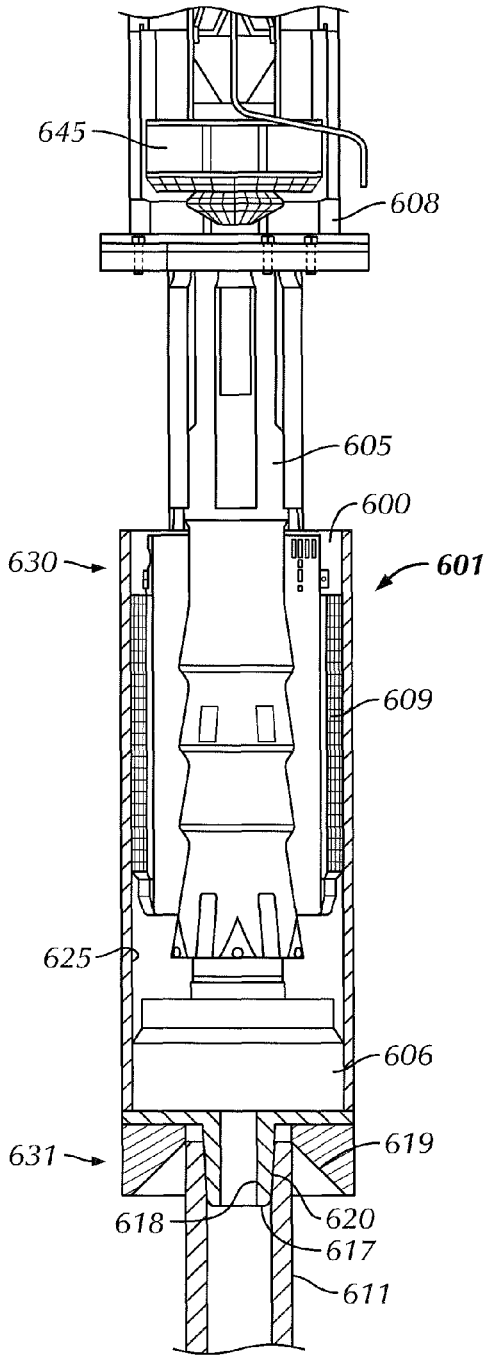
FIG. 6 is a cross-sectional view of a system having an adaptor apparatus engaged with a top drive mounted gripping tool and a tubular member in accordance with embodiments disclosed herein.

Referring now to FIG. 6, a cross-sectional view of a system having an adaptor apparatus 601 engaged with a top drive mounted gripping tool 605 and a tubular member 611 in accordance with embodiments disclosed herein, is shown. A first end 630 of adaptor apparatus 601 may be engaged with a top drive mounted gripping tool 605 and a second end 631 may be connected with a tubular member 611. As shown, top drive assembly 645 may be suspended along guide rails 608 and may engage gripping tool 605. Gripping tool 605 may be disposed within a bore 600 formed within first end 630 of adaptor apparatus 601. The at least one gripping member 609 of gripping tool 605 may be securely engaged with an inner wall surface 625 of adaptor apparatus 601. This engagement may allow any torque or movement experienced by gripping tool 605 as a result of top drive assembly 645 may be transferred to adaptor apparatus 601. Furthermore, the gripping tool 605 may have a seal member 606 attached thereto, in which the seal member 606 may be able to sealingly engage with the inner surface 625 of the adaptor apparatus 601. However, those having ordinary skill will appreciate that other structures and arrangements may be used for engaging the adaptor apparatus with the gripping tool without departing from the scope of the present disclosure. For example, the gripping tool may engage the with the adaptor apparatus by having the at least one gripping member contract radially inward with respect to the axis, to securely engage, for example, with the outer wall surface of the adaptor apparatus (discussed more below).

Further, a tubular drill pipe member 611 may be disposed along a bell guide 619 and connected with a male pin connection member 617 on second end 631 of adaptor apparatus 601. Tubular drill pipe member 611 in the present embodiment includes a mating female box connection member 620, corresponding to male pin connection member 617 included in adaptor apparatus 601. However, those having ordinary skill will appreciate that a variety of connection structures and arrangements may be used to connect the adaptor apparatus and the tubular drill pipe member that, likewise, may ensure a secure engagement such that any torque or movement experienced by the adaptor apparatus may be transferred to the tubular drill pipe member. Torque may be produced by top drive assembly 645 and may be transferred through gripping tool 605 to tubular drill pipe member 611 through adaptor apparatus 601. Furthermore, second end 631 of adaptor apparatus 601 may include a hole 618, or port, formed therein, such as by having hole 618 formed within male connection member 617. In such embodiments, hole 618 may enable one or more tools and/or components to be fluidly coupled to each other through adaptor apparatus 601, such as by having hole 618 enable gripping tool 605 to be fluidly coupled to tubular member 611, in addition to any other tools and/or components attached to tubular member 611.

An adaptor apparatus 601, such as shown in FIG. 6, may be used to transfer the torque from a gripping tool 605 to drill pipe 611. As such, this may eliminate the need to rig up and rig down gripping tool 605 whenever a borehole requires casing. Rather, adaptor apparatus 601 may be mounted onto gripping tool 605 and secured using the at least one gripping member 609 of gripping tool 605. A tubular drill pipe member 611 may be secured to second end 631 of adaptor apparatus 601 and the torque from top drive mounted gripping tool 605 may be transferred to tubular drill pipe member 611. The torque from the drill pipe member may be transferred, for example, to a drill bit or reamer (not shown) at the bottom of the string of drill pipe members that may assist in the wellbore drilling process.

Those having ordinary skill will appreciate that other structures and arrangements may be used to engage the adaptor apparatus with the gripping tool without departing from the scope of the present disclosure. As such, in one or more embodiments, the gripping tool may engage with the adaptor apparatus by having the at least one gripping member contract radially inward with respect to the axis, to securely engage, for example, the outer wall surface of the adaptor apparatus.

Figure 7:
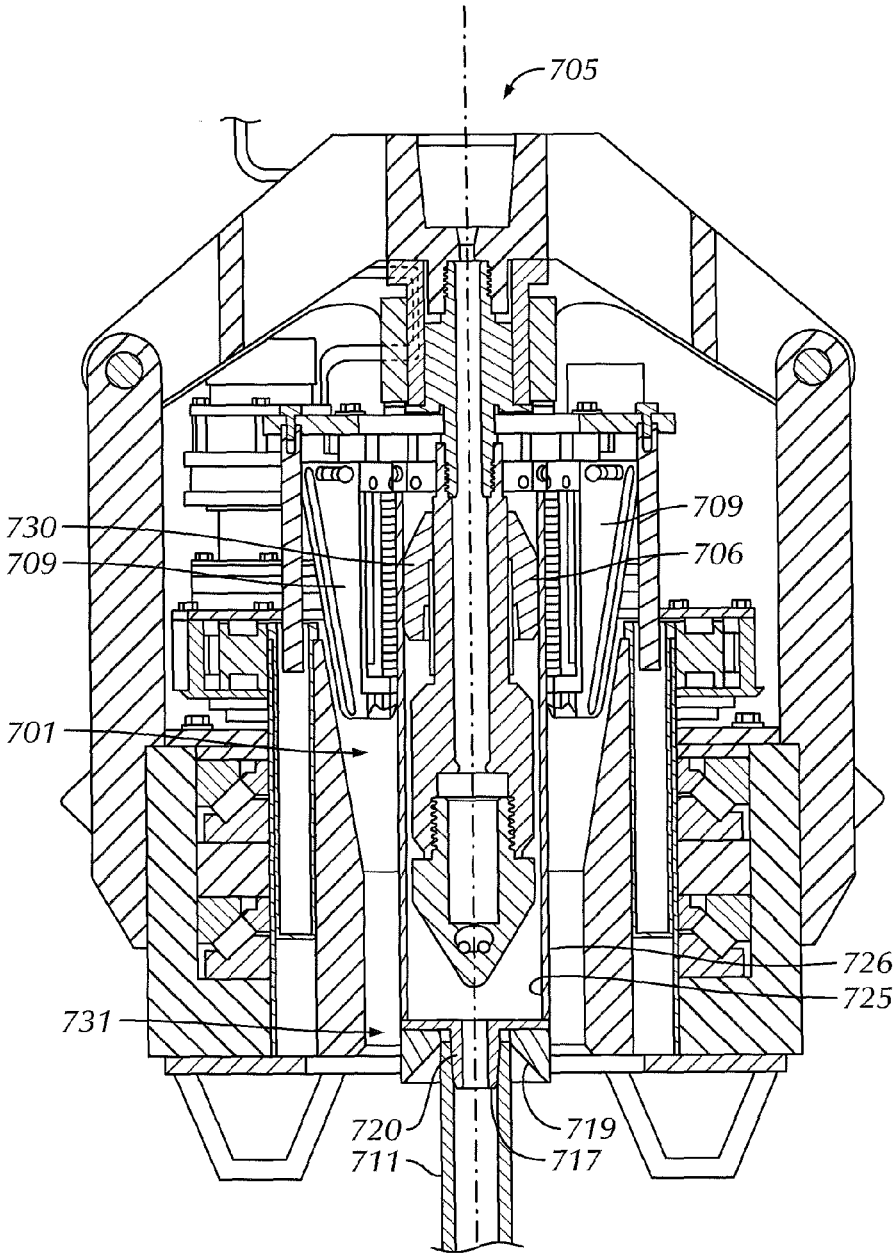
FIG. 7 is a cross-sectional view of a system having an adaptor apparatus engaged with a top drive mounted gripping tool and a tubular member in accordance with embodiments disclosed herein

For example, referring now to FIG. 7, a cross-sectional view of a system having an adaptor apparatus 701 engaged with a top drive mounted gripping tool 705 and a tubular member 711 in accordance with embodiments disclosed herein is shown. As such, in this embodiment, the top drive mounted gripping tool 705 may be an external gripping tool, rather than an internal gripping tool (e.g., as shown in FIGS. 5 and 6).

A first end 730 of adaptor apparatus 701 may be engaged with a top drive mounted gripping tool 705 and a second end 731 may be connected with a tubular member 711. A top drive assembly may be suspended from a drilling rig and may engage gripping tool 705. Gripping tool 705 may be disposed about first end 730 of adaptor apparatus 701. As such, the at least one gripping member 709 of gripping tool 705 may be securely engaged with an outer wall surface 726 of adaptor apparatus 701. This engagement may allow any torque or movement experienced by gripping tool 705 as a result of top drive assembly to be transferred to adaptor apparatus 701. Further, the gripping tool 705 may have a seal member 706 attached thereto, in which the seal member 706 may be able to sealingly engage with the inner surface 725 of the adaptor apparatus 701.

A tubular drill pipe member 711 may be disposed along a bell guide 719 and connected with a male pin connection member 717 on second end 731 of adaptor apparatus 701. Tubular drill pipe member 711 in the present embodiment includes a mating female box connection member 720, corresponding to male pin connection member 717 included in adaptor apparatus 701.

Adaptor apparatus 701 may be used to transfer the torque from a gripping tool 705 to drill pipe 711. As such, this may eliminate the need to rig up and rig down gripping tool 705 whenever a borehole requires casing. Rather, adaptor apparatus 701 may be mounted onto gripping tool 705 and secured using the at least one gripping member 709 of gripping tool 705. A tubular drill pipe member 711 may be secured to second end 731 of adaptor apparatus 701 and the torque from top drive mounted gripping tool 705 may be transferred to tubular drill pipe member 711. The torque from the drill pipe member may be transferred, for example, to a drill bit or reamer at the bottom of the string of drill pipe members, or to another string of tubular members connected to a string of tubular members connected to the adaptor apparatus (e.g., a casing string attached to a landing string, the landing string attached to the adaptor apparatus).

Examples of other alternative gripping apparatuses having gripping members to grip internal and external surfaces of tubular members in accordance with one or more embodiment disclosed herein are disclosed within U.S. patent application Ser. No. 11/912,665, filed on Oct. 25, 2007, and entitled "Gripping Tool," U.S. Pat. No. 6,309,002, filed on Apr. 9, 1999, and entitled "Tubular Running Tool," U.S. Pat. No. 6,431,626, filed on Feb. 11, 2000, and entitled "Tubular Running Tool,' and U.S. patent application Ser. No. 12/414,645, filed on Mar. 30, 2009, each of which are incorporated herein by reference in their entirety.

In yet another embodiment, those having ordinary skill will appreciate that the adaptor apparatus may be mounted to a gripping tool, rather than by having the gripping tool engage and grip the adaptor apparatus. In this embodiment, a first end of the adaptor apparatus may be adapted to engage with the gripping tool, in which the first end of the adaptor apparatus may use a threaded connection to securely engage with the gripping tool. A second end of the adaptor apparatus may be adapted to connect with different tubular members, such as tubular drilling members and tubular casing members. This embodiment may also provide similar benefits as the previously described embodiment, allowing torque to transfer from the top drive assembly to a tubular member without mounting and dismounting a gripping tool. Those having ordinary skill will appreciate that the present disclosure contemplates other structures and arrangements in accordance with embodiments disclosed herein. For example, many connections illustrated herein are threaded; however, it should be understood that other methods for connection may be utilized, such as through other mechanical means and/or welding. Additionally, the present disclosure should not be considered limited to a particular material or method of construction. Therefore, many materials of construction are contemplated by the present disclosure including but not limited to metals, composites, and plastics, as well as combinations and variations thereof.

One method to connect a gripping tool to a tubular member using an adaptor apparatus may include engaging a first end of the adaptor apparatus with the gripping tool and a second end of the adaptor apparatus with a tubular member. The gripping tool may engage with the first end of the adaptor apparatus by disposing one or more gripping members of the gripping tool within a bore on the first end of the adaptor apparatus. The adaptor apparatus of the gripping tool may expand radially outward with respect to an axis defined therethrough and securely engage with an inner wall surface of the first end of the gripping member. The second end of the adaptor apparatus may include a male pin connection member disposed adjacent to the bell guide which may be used to connect the adaptor apparatus with a tubular member. However, those having ordinary skill will appreciate that other structures and arrangements may be used to connect the adaptor apparatus with a tubular member without departing from the scope of the present disclosure. For example, instead of a male pin connection member, the adaptor apparatus may include a female box connection member, such as disposed adjacent to the bell guide on the second end of the adaptor apparatus. The female box connection member may be used to engage with the corresponding connecting configuration featured on a tubular member, such as a male pin connection member or male thread on a tubular member.

An alternative embodiment may allow the gripping tool to engage with the first end of the adaptor apparatus by disposing the one or more gripping members of the gripping tool over the outer wall surface of the adaptor apparatus. The gripping members of the gripping tool may contract radially inward with respect to an axis defined therethrough and securely engage with an outer wall surface of the first end of the gripping member.

Once the adaptor apparatus is securely engaged with both the gripping tool and the tubular member, any torque experienced by the gripping tool may be transferred through the adaptor apparatus to the tubular member. Likewise, any torque experience by the tubular member may be transferred through the adaptor apparatus to the gripping tool.

Those having ordinary skill will appreciate that the present disclosure contemplates other structures and arrangements in accordance with the methods disclosed herein. For example, the adaptor apparatus may be mounted without the use of a gripping tool. The first end of the adaptor apparatus may be engaged with a top drive assembly and the second end of the adaptor apparatus may be connected with a tubular member.

Once a top drive assembly or gripping tool is securely engaged with the first end of the adaptor apparatus and a tubular member is securely connected with the second end of the adaptor apparatus, all three of the gripping tool or top drive assembly, adaptor apparatus, and tubular member may rotate together along an axis defined through the adaptor apparatus. The tubular member may also securely connect to a string of tubular members and a drill bit. As a result, any torque experienced by the top drive assembly or gripping tool may be transferred through the adaptor apparatus to the string of tubular members and the drill bit. Likewise, any torque experienced by the string of tubular members or the drill bit may be transferred through the adaptor apparatus to the top drive assembly or gripping tool. The top drive assembly may then be used to drive the string of tubular members and the drill bit into a wellbore, in which driving includes at least one of applying torque to the tubular member from the top drive assembly through the gripping tool and the adaptor apparatus, or applying a force along the axis of the gripping tool to the tubular member from the top drive assembly through the gripping tool and the adaptor apparatus.

To dismount the adaptor apparatus, the gripping tool may disengage from the first end of the adaptor apparatus and the tubular member may disconnect from the second end of the adaptor apparatus. The gripping tool may disengage the first end of the adaptor apparatus by contracting the gripping members of the gripping tool that may be disposed with a bore on the first end of the adaptor apparatus. The gripping members may then contract radially inward with respect to an axis defined therethrough in order to disengage from the inner wall surface of the first end of the adaptor apparatus.

Figure 8:
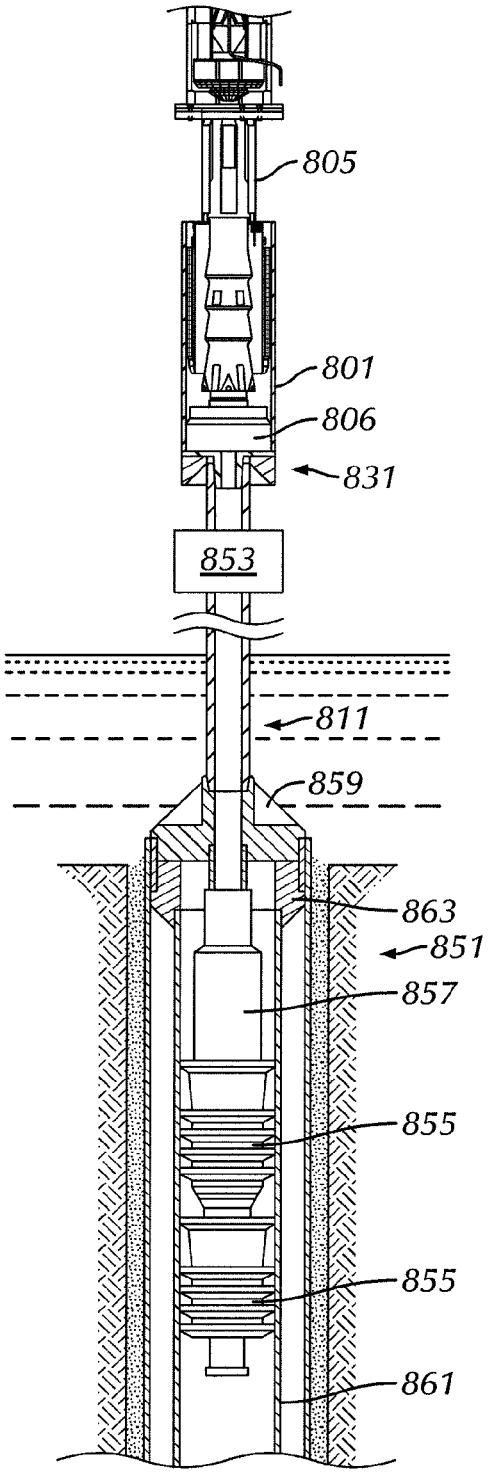
FIG. 8 is a cross-sectional view of a system having an adaptor apparatus engaged with a top drive mounted gripping tool and a tubular member in accordance with embodiments disclosed herein.

Alternatively, certain embodiments may allow the gripping tool to disengage with the first end of the adaptor apparatus by expanding the at least one gripping member of the gripping tool over the outer wall surface of the adaptor apparatus. The at least one gripping member of the gripping tool may expand radially outward with respect to an axis defined therethrough and disengage with an outer wall surface of the first end of the gripping member. Other tools may be used in addition to a gripping tool. For example, referring briefly to FIG. 8, an embodiment is shown in which one or more tools are provided in addition to a gripping tool 805, in which gripping tool 805 has a seal member 806 attached thereto and is shown as engaged with an adaptor apparatus 801. In this embodiment, a second end 831 of adaptor apparatus 801 may be engaged with a string of tubular members 811, such as a landing string, in which one or more tools may be engaged with the string of tubular members 811. For example, in this embodiment, one or more cementing tools of a cementing system 851 may be attached to the string of tubular members 811. Cementing system 851 may include a ball or dart plug apparatus 853, in which the ball plug apparatus 853 may be operably coupled to cementing plugs 855 and a plug release assembly 857. Plug release assembly 857 may be suspended from a head adaptor 859, in which plug release assembly 857 and cementing plugs 855 may be disposed within a casing string 861 suspended from a casing hanger 863. As such, this system of tools shown in FIG. 8 may be used to induce a cementing process downhole, such as upon the exterior of the casing string 861.

Embodiments disclosed herein may provide for one or more of the following advantages. First, embodiments disclosed herein may advantageously provide for an adaptor apparatus that may increase efficiency of a drilling rig. For example, when a section of a well has been completed, the drill pipe running equipment may be dismounted and the casing running tool may be mounted before the well may be cased. This mounting and dismounting process is time consuming and extends drilling time and thus, increases drilling costs. Further, potential time lost during the mounting and dismounting process is exacerbated when several short sections of a wellbore are drilled because the same amount of time is spent mounting and dismounting the drill pipe running equipment, regardless of the length of the drill section.

Furthermore, embodiments disclosed herein may provide for an adaptor apparatus that may prevent the circulation of fluids from stopping for extended periods of time. Extended delays in the circulation of drilling fluids are due to the mounting and dismounting process of the drill pipe equipment. This mounting and dismounting process causes fluid in the wellbore to remain static and may become problematic when the fluid needs to be circulated in order to maintain the pressure of the well while further extending production time and costs.

Furthermore, it should be understood by those having ordinary skill that the present disclosure shall not be limited to specific examples depicted in the Figures and described in the specification. As such, various mechanisms to transfer torque from a top drive mounted gripping tool to a tubular member may be used without departing from the scope of the present disclosure. While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A system to connect a top drive drilling assembly to a tubular member, the system comprising:

a gripping tool operatively connected to and suspended from the top drive assembly, wherein the gripping tool comprises an axis defined therethrough and a gripping member;

an adaptor apparatus comprising a first end and a second end and a cylindrical body, the cylindrical body having a nominal outer diameter larger than a nominal outer diameter of the tubular member;

wherein the gripping member engages the adaptor apparatus; and wherein the second end comprises a connection member to connect with the tubular member.

2. The system of claim 1, wherein the gripping member of the gripping tool grips an internal surface of the adaptor apparatus.

3. The system of claim 2, wherein the gripping member of the gripping tool moves radially outward with respect to the axis.

4. The system of claim 1, wherein the gripping member of the gripping tool grips an external surface of the adaptor apparatus.

5. The system of claim 4, wherein the gripping member of the gripping tool moves radially inward with respect to the axis.

6. The system of claim 1, wherein the gripping tool is operatively connected to and suspended from a quill of the top drive assembly.

7. The system of claim 1, wherein the second end of the adaptor apparatus comprises one of a male threaded connection member and a female threaded connection member.

8. The system of claim 1, wherein the adaptor apparatus further comprises a bell guide disposed adjacent to the connection member of the adaptor apparatus.

9. The system of claim 1, wherein the axes of the gripping tool, adaptor apparatus, and tubular member are coaxial.

10. An apparatus to allow a gripping tool of a top drive assembly to connect to a tubular member, the apparatus comprising:

a cylindrical body having a first end and a second end, the cylindrical body having a nominal outer diameter larger than a nominal outer diameter of the tubular member;

wherein the first end is configured to be engaged by the gripping tool; and wherein the second end comprises a connection member to threadably connect to the tubular member.

11. The apparatus of claim 10, wherein the body comprises a bore at least partially formed therethrough, wherein the gripping tool is at least partially disposed within the bore, wherein a gripping member grips an inner wall surface of the cylindrical body.

12. The apparatus of claim 10, wherein the connection member of the adaptor apparatus comprises one of a male thread and a female thread.

13. The apparatus of claim 10, wherein the adaptor apparatus further comprises a bell guide disposed adjacent to the connection member of the adaptor apparatus.

14. The apparatus of claim 10, wherein the second end of the apparatus comprises a hole formed therein such that the apparatus is in fluid communication with the tubular member.

15. A method to run a tubular member with a top drive assembly, the method comprising:

providing a gripping tool between the top drive assembly and the tubular member, the gripping tool having a gripping member and an axis defined therethrough;

gripping an adaptor apparatus with the gripping member of the gripping tool, the adaptor apparatus comprising a cylindrical body, the cylindrical body having a nominal outer diameter larger than a nominal outer diameter of the tubular member; and connecting the adaptor apparatus to the tubular member.

16. The method of claim 15, further comprising:

rotating the gripping tool using the top drive assembly, wherein the gripping tool is operatively connected to a quill of the top drive assembly;

wherein the adaptor apparatus is rotated with gripping tool; and wherein the tubular member is rotated with the adaptor apparatus.

17. The method of claim 15, wherein gripping the adaptor apparatus comprises:

moving the gripping member of the gripping tool radially inward with respect to the axis of the gripping tool to grip the adaptor apparatus.

18. The method of claim 15, wherein gripping the adaptor apparatus comprises:

moving the gripping member of the gripping tool radially outward with respect to the axis of the gripping tool to grip the adaptor apparatus.

19. The method of claim 15, further comprising:

disconnecting the adaptor apparatus from the tubular member;

disengaging the gripping member of the gripping tool from the adaptor apparatus; and gripping another tubular member with the gripping member of the gripping tool.

20. The method of claim 15, wherein the adaptor apparatus comprises one of a male connection member and a female connection member to connect to the tubular member.

* * * * *